United States Patent [19]

Braasch

[11] Patent Number: 4,465,548

[45] Date of Patent: Aug. 14, 1984

[54] METHOD FOR BONDING GRINDING MATERIAL ONTO A GRINDING DISK AND A GRINDING DISK SO MADE

[76] Inventor: Gerd Braasch, Sassenberg 31, 4475 Sögel, Fed. Rep. of Germany

[21] Appl. No.: 423,422

[22] Filed: Sep. 24, 1982

[30] Foreign Application Priority Data

Dec. 8, 1981 [DE] Fed. Rep. of Germany ..... 3148499

[51] Int. Cl.[3] ..... B24D 11/00; B23F 21/03; B29C 17/08; C03C 15/00

[52] U.S. Cl. ..... 156/630; 51/209 R; 51/297; 156/631; 156/344; 156/668

[58] Field of Search ..... 51/293, 297, 209 DL, 51/209 R; 156/630, 631, 155, 344, 668

[56] References Cited

U.S. PATENT DOCUMENTS

| | | | |
|---|---|---|---|
| 4,010,583 | 3/1977 | Highberg | 51/297 X |
| 4,263,755 | 4/1981 | Globus | 51/297 X |
| 4,331,453 | 5/1982 | Dau et al. | 51/298 |

*Primary Examiner*—William A. Powell
*Attorney, Agent, or Firm*—Collard, Roe & Galgano

[57] ABSTRACT

The invention relates to a method for bonding grinding material, in particular, endless grinding belts or grinding belt segments onto a grinding element, preferably a grinding disk, or the like. Used endless grinding belts can be removed from the grinding elements only under great difficulties. However, such operations must be performed at regular intervals, as soon as the service life of the endless grinding belt has been exceeded. In particular, the removal of adhesive residues from the grinding element is a tedious task and the use of aggressive solvents is disadvantageous for the adhesive. In order to eliminate these disadvantages, the invention provides that a separating layer which is made of an unstable material with respect to solvents, is applied on at least one of the two engaging faces of an endless grinding belt and the grinding element before applying the adhesive layer. Preferably, the separating layer is mounted on the engagement face of the grinding element. As a material for the separating layer, an adhering agent, for example, a plastic resin is particularly suitable. The endless grinding belt can be bonded onto this adhering agent. Since the material used for the separating layer is easily dissolvable with a mild solvent, a used endless grinding belt can be easily removed from the grinding element, without any remaining adhesive residues.

12 Claims, 2 Drawing Figures

Figure 1:
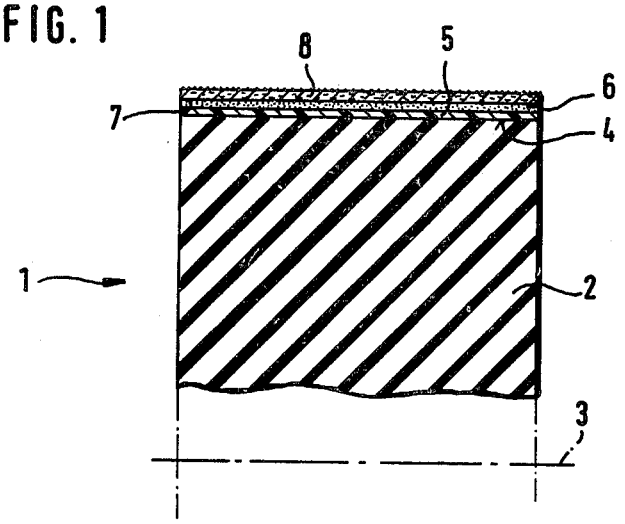

METHOD FOR BONDING GRINDING MATERIAL ONTO A GRINDING DISK AND A GRINDING DISK SO MADE

The invention relates to a method for bonding grinding material, in particular, an endless grinding belt or grinding belt segments, onto a grinding element, preferably a grinding disk or the like, and to a grinding disk so made.

In particular, in the furniture industry, where smooth as well as profiled surfaces have to be ground, one uses grinding elements whose surfaces, mostly the circumferential surfaces which engage the surfaces to be ground, are covered or sheathed with an endless grinding belt. The endless grinding belt is bonded directly onto the associated outer face of the grinding element with its fabric or paper-side by means of a contact adhesive, for example.

Instead of an endless grinding belt, belt segments may be bonded onto the grinding elements, especially, when the surface of the grinding element to be bonded is a profiled element, so as to process a similarly profiled wood surface, for example.

As soon as the service life of the grinding material or the endless grinding belt is exhausted, one has to remove the used endless grinding belt from the grinding element and replace it with a new one.

The removal of the used endless grinding belt from the grinding element is a tedious and expensive operation. For example, the grinding elements are immersed into a solvent for dissolving the adhesive layer between the engagement faces of the grinding element and the endless grinding belt. However, a complete dissolving of the adhesive layer between the engagement faces of the grinding element and the endless grinding belt is not obtained and the adhesive layer is merely somewhat dissolved. When tearing off the used endless grinding belt, adhesive residues adhere to the grinding element which can only be removed by a rough mechanical surface treatment. For example, a strong scrubbing with steel wool with additional solvent is usually required.

Often the grinding elements consist of elastic material, like rubber or cork, so that when tearing off the used endless grinding belt in areas in which the adhesive has not been completely dissolved, pieces are torn out of the engagement face of the grinding element, so that the grinding element is rendered unusable.

The hitherto used method for removing used endless grinding belts from the grinding elements also has the disadvantage that relatively aggressive solvents must be used, whose use is very unpleasant and often dangerous to the user's health. By using an aggressive solvent, the material of the grinding element can also be attacked and destroyed. In particular, in grinding elements which are provided with predetermined profile contours, the cut-out profile contour of the grinding element could be destroyed due to a repeated hard scrubbing during removal of adhesive residues, so that the grinding element is rendered unusable for processing the profiled workpieces.

It is therefore an object of the invention to afford a method for bonding grinding material, especially an endless grinding belt, onto a rotatable grinding element which enables an easier dissolving and removal of a used endless grinding belt from the grinding element.

This object of the invention is solved in accordance with the invention in that a separating layer, which is made from an unstable material with respect to the solvents to be used, is applied on at least one of the two engaging faces of the endless grinding belt and the grinding element before applying the adhesive layer.

In an advantageous manner the separating layer prevents direct contact of the adhesive with the engaging faces to be bonded. Therefore, in order to remove a used endless grinding belt, for example, from a grinding disk, it suffices to dissolve the separating layer. Preferably, the separating layer has the characteristic that it can be easily dissolved in a relatively mild solvent when the grinding element with the endless grinding belt is immersed into a solvent. Therefore, it is no longer required to use aggressive solvents for dissolving the adhesive layer. Furthermore, as soon as the separating layer has been dissolved, adhesive residues no longer remain on the engagement faces.

Preferably, the separating layer is applied on the engagement face of the grinding element, so that after this separating layer has been dissolved by the solvent, the endless grinding belt can be removed, together with the remainder of the adhesive residues which still adhere to its engagement face.

In a preferred embodiment, an easily dissolvable separating layer is applied on the engagement face of the grinding element and the engagement face of the endless grinding belt is coated with a material which is stable with respect to the same solvent.

In particular, when the separating layer is an adhesive agent, a connection of particular rigidity is obtained between the grinding element and the endless grinding belt when using adhesive agents of different dissolvability.

A vinyl resin may be used as an adhering agent, for example. One also could use a polyurethane resin. Naturally, a mixture of the two resins is also possible.

The use of a resin as the adhering agent is preferable. Naturally, however, other adhering agents may be used, the important criteria for their use as a separating layer of the used adhesives being certain characteristics—namely, they must be highly flexible and temperature resistant and must have excellent adhesion characteristics, so as to enable a fixed connection with the engagement faces of the grinding element and the endless grinding belt. This is also true for the connecting characteristics with the adhesive to be used which preferably is a contact adhesive.

Furthermore, the adhering agent used as a separating agent should be able to dry rapidly after application. A further important characteristic which the adhering agent being used as a separating layer should fulfill is its ability to dissolve in a solvent which is not dangerous to one's health, which is not aggressive and which is uncomplicated in its processing.

When using vinyl or polyurethane resins which fulfill the aforementioned characteristics, the additional advantageous possibility exists of adjusting the solvent used with respect to the resin employed by adding a hardening agent. This results in the already described advantage that an adhering agent can be applied on the fabric side of the endless grinding belt or the individual grinding belt segments which, by the addition of a hardening agent, is hardly partially dissolved at all, while the separating agent applied on the engagement face of the grinding element, to which a hardening agent is not added, can be easily dissolved.

Any remaining adhesive residues can be removed by a light scrubbing without damaging the grinding element. By using different adhesives, a light one and a heavy one, one obtains a relatively high bonding rigidity of the connection of the endless grinding belt with the grinding element.

Materials preferably used for the separating layer are, e.g., alcohol, in particular, ethanol, as the solvent. Naturally, a material for the inventive separating layer would be feasible which dissolves in water. However, water has the disadvantage that metallic parts of the grinding element could be attacked due to corrosion. This is not the case with ethanol.

The inventive measures have the advantage that they can be used with all grinding elements made of cork, rubber, metal, wood, or the like, which are provided with grinding materials which are bonded thereon. In order to replace the grinding material after its useful service life, one does not have to pre-dissolve the adhesive any longer. After dissolving the separating layer, the endless grinding belt can be easily separated from the grinding element. A cumbersome and expensive preparation of the grinding elements, before mounting a new endless grinding belt is eliminated, so that the grinding elements can be again used in the shortest time possible, for example, for reuse in a grinding machine.

Other objects and features of the present invention will become apparent from the following detailed description, considered in connection with the accompanying drawing, which discloses several embodiments of the invention. It is to be understood, however, that the drawing is designed for the purpose of illustration only, and not as a definition of the limits of the invention.

Figure 2:
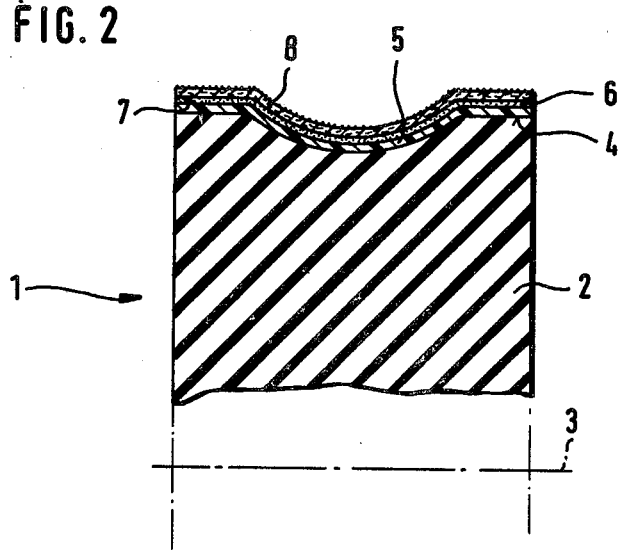

In the drawing, wherein similar reference characters denote similar elements throughout the several views:

FIG. 1 is a schematic sectional view through the upper half of a grinding disk having a straight circumferential face; and FIG. 2 is a schematic sectional view through the upper half of a grinding disk with a profiled circumferential face.

Referring now in detail to the drawing, FIG. 1 shows the upper half of a grinding disk 1 in a sectional view. The grinding disk consists of a grinding element 2 made of rubber which can rotate around the indicated axis 3. A separating layer 5 consisting of an adhesive, for example, a vinyl resin, is applied to the circumferential engagement face 4 of the grinding element 2. After drying the separating layer 5, an adhesive layer 6 is applied which encompasses the circumference of the grinding element 2 and which bonds the engagement face 7 of the endless grinding belt 8, with the grinding element 2.

FIG. 2 shows a sectional view through a grinding disk whose circumference, and therefore also its engagement face, is profiled, so that the endless grinding belt 8 is provided with a similar profile contour. The separating layer 5 formed by the adhesive, as well as the adhesive layer 6 and the common engagement faces 4 and 7 are again designated with the same reference numeral as in FIG. 1.

Thus, while only several embodiments of the invention have been shown and described, it will be obvious that many changes and modifications may be made thereunto, without departing from the spirit and scope of the invention.

What is claimed is:

1. A method for adhering a grinding belt onto a grinding element, comprising the steps of:

applying a separating layer which is made from an unstable material with respect to a solvent, on at least one of the two engaging faces of the endless grinding belt and the grinding element; and subsequently applying an adhesive layer between said engaging faces to effect releasable adherence of said grinding belt to said grinding element.

2. The method of claim 1, wherein said separating layer is applied onto the engagement face of said grinding element.

3. The method of claim 1, wherein said separating layer is applied onto the engagement face of said grinding element, and wherein a separating layer is applied onto the engagement face of the endless grinding belt composed of a material relatively stable against solvents.

4. The method of claim 1, wherein an adhesive agent is used as said separating layer.

5. The method of claim 4, wherein a vinyl resin is used as said adhesive agent.

6. The method of claim 4, wherein a polyurethane resin is used as said adhesive agent.

7. The method of claim 4, wherein a mixture of vinyl resin and polyurethane resin is used as said adhesive agent.

8. The method of claim 1, additionally including the step of adding a hardening agent to said material used for the separating layer.

9. The method of claim 1, additionally including the step of dissolving said separating layer by applying a solvent thereto.

10. The method of claim 9, wherein alcohol is used as said solvent agent.

11. The method of claim 10, wherein said alcohol is ethanol.

12. The method of claim 11, wherein said layer of material is applied to said engagement face of said grinding element.

* * * * *